United States Patent [19]

Joyce

[11] 4,391,375

[45] Jul. 5, 1983

[54] DISPLAY CARD AND ASSEMBLY HANGER

[75] Inventor: Robert D. Joyce, Greenville, R.I.

[73] Assignee: Joyce Card & Display Co., Providence, R.I.

[21] Appl. No.: 257,908

[22] Filed: Apr. 27, 1981

[51] Int. Cl.[3] ..... A47F 7/00

[52] U.S. Cl. ..... 211/13; 40/10 R; 40/617; 211/94; 312/184; 312/193

[58] Field of Search ..... 211/45, 46, 94, 162, 211/87, 13; 40/156, 617, 10 R; 248/316.4, 489, 544, 221.3; 312/184, 185, 186, 187

[56] References Cited

U.S. PATENT DOCUMENTS

| | | | |
|---|---|---|---|
| 1,417,009 | 5/1922 | Woodward | 211/45 X |
| 1,910,933 | 5/1933 | Holm | 211/45 |
| 2,530,821 | 11/1950 | Hubbell | 40/617 X |
| 2,779,118 | 1/1957 | Gundlach | 40/617 X |
| 3,399,429 | 9/1968 | Goodman | 248/489 X |
| 3,531,879 | 10/1970 | Bogese | 40/124.4 |
| 3,591,013 | 7/1971 | Von Herrmann | 248/316.4 X |
| 3,970,276 | 7/1976 | Debaigt | 248/221.3 |
| 3,975,805 | 8/1976 | Spurling et al. | 211/45 |
| 4,155,457 | 5/1979 | Wilbert | 211/13 X |
| 4,175,660 | 11/1979 | Feibelman | 206/468 |

FOREIGN PATENT DOCUMENTS

| | | | |
|---|---|---|---|
| 1194367 | 6/1965 | Fed. Rep. of Germany | 312/184 |
| 611489 | 3/1959 | Italy | 312/184 |

*Primary Examiner*—James T. McCall
*Assistant Examiner*—David L. Talbott
*Attorney, Agent, or Firm*—Salter & Michaelson

[57] ABSTRACT

A device for displaying jewelry and the like comprising a display card of cardboard or the like which is suspended from a hanger mounted on a vertical supporting surface. An outwardly biased flap is hingedly attached to the upper edge of the card extending downwardly therefrom. A pair of spaced horizontal ribs are provided in the hanger with the lower rib engaging beneath the bottom edge of the flap to provide vertical support for the card and with the upper rib engaging the flap at the intermediate point in its extension. The hanger has a top wall terminating in a downwardly extending flange or wall that is spaced outwardly from the ribs thereby retaining the flap in engagement with the lower rib. The flap is disengaged from the lower rib simply by moving the bottom of the card outwardly causing the flap to be depressed against the upper rib and thereby swing inwardly toward the main portion of the card whereupon the bottom edge of the flap clears the lower rib so that the card may be downwardly removed from the hanger.

9 Claims, 6 Drawing Figures

DISPLAY CARD AND ASSEMBLY HANGER

BACKGROUND OF THE INVENTION

The instant invention relates to the display of ornamental jewelry and the like, and more particularly to a display card which may be hung or suspended from a supporting surface with an article of ornamental jewelry attached thereto.

The display of ornamental jewelry on display cards is well known and has in the past proven to be a particularly effective way of displaying jewelry for marketing. An article of jewelry is attached to the front surface of a small display card made generally of cardboard or plastic and the card with the article on it is hung from a supporting surface or display rack. Previously known devices of this general type have included various means for detachably securing the card to a hanger or supporting rack. Frequently a small hole has been provided on the top portion of the card whereby the card is suspended from a hook or a hanger on the surface of a rack. Alternatively, various types of hooks or hangers have been provided on the tops of cards to suspend the cards from bars or rods of various configurations.

Generally the most attractive and therefore the most effective display devices for jewelry heretofore available have employed cards with rearwardly extending flanges which engage a portion of a rack to thereby suspend the cards from a supporting surface. Examples of display cards for use in this type of display are illustrated in the U.S. Patents to FIEBLEMAN U.S. Pat. Nos. 3,958,788 and 4,175,660. Unfortunately, however, displays of this type wherein a card is suspended from a rack or a bracket on a supporting surface have heretofore only been possible when preformed plastic cards were used. The display device of the instant invention provides a novel means for suspending a display card from a supporting surface wherein for the first time economical cardboard display cards may be used. The cards used in the display device of the instant invention have a flap which extends downwardly from the upper edge of the main portion thereof, being hingedly attached thereto along a score line. The card is then suspended from a bracket or hanger mounted on a supporting surface wherein the flap assumes an inclined position providing vertical support for the card. Since the flap is hingedly attached to the upper portion of the card and does not need to be rigidly attached thereto in order to support the card, it is, for first time, possible to use less expensive cardboard cards in displays of this general type.

Obviously one of the primary concerns with any jewelry display device is its overall attractiveness. The device of the instant invention is a particularly attractive display device for suspending cards on a supporting surface. The cards are inserted upwardly into the hanger and the actual mechanism for supporting the card is concealed from view so as not to distract the attention of a prospective purchaser.

Furthermore since the actual mechanism for supporting the cards is concealed from view, the method of removing the cards from the rack, although quite simple, is not readily obvious. As a result, the display device of the instant invention tends to discourage and lessen jewelry pilferage.

Previously known devices of this general type representing the closest prior art of which the applicant is aware are disclosed in the following U.S. Pat. Nos.:

HUBBELL, 2,530,821; BOGESE, 3,531,879; HERRIMANN, 3,591,013. None of these patents, however, capture the spirit of the instant invention since none of them disclose or teach a display device which is attachable to a supporting surface in a manner similar to that herein disclosed. Consequently, the display device of the instant invention represents a substantial departure from previously known display devices and constitutes a significant improvement in the art by providing an effective display device which is both attractive and economical.

SUMMARY OF THE INVENTION

The instant invention relates to the display of ornamental jewelry and the like on display cards which may be suspended from a supporting surface, and is particularly concerned with display cards constructed of cardboard or similar structurally weak, inexpensive materials.

The display device of the instant invention provides a novel means for detachably suspending a display card of cardboard or the like from a supporting surface. A substantially rectangular cardboard card is provided having an outwardly biased flap hingedly attached to the top edge of the main portion thereof and extending rearwardly and downwardly therefrom. An elongated hanger, preferably of extruded plastic, comprising a pair of outwardly extending elongated ribs and an elongated L-shaped member which extends outwardly above the ribs and downwardly in front thereof is mounted in substantially horizontal disposition on the supporting surface. The display card is receivable between the vertical portion of the L-shaped member and the ribs with the bottom edge of the outwardly biased flap engaging the top surface of the lower rib to provide vertical support for the card. The upper rib engages the flap intermediate the extent thereof with the upper portion of the front surface of the card engaging the rear surface of the vertical portion of the L-shaped member. With the card so positioned, the flap assumes a rearwardly inclined position extending from the lower rib to a point adjacent the upper inner surface of the L-shaped member, thereby effecting a locking of the card in the hanger. The card may thereafter be simply and easily removed from the hanger by applying a slight outward force on the bottom portion of the card causing the upper rib to act as a fulcrum depressing the flap inwardly towards the rear of the main portion of the card. This results in the disengagement of the bottom edge of the flap from the lower rib whereupon the card may be moved downwardly to detach it from the hanger.

Accordingly, it is an object of the instant invention to provide an effective display device for articles of jewelry and the like wherein the articles are simply and easily attached to or detached from a supporting surface.

Another object of the instant invention is to provide a display device wherein cards are suspended from a supporting surface by means of an outwardly biased flap hingedly attached to the top edge of the main portion thereof.

A still further object of the instant invention is to provide a neat and attractive device for displaying jewelry and the like on a supporting surface.

A still further object of the instant invention is to provide a jewelry display device using a detachable display card of a lightweight, structurally weak, inexpensive material, such as cardboard.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
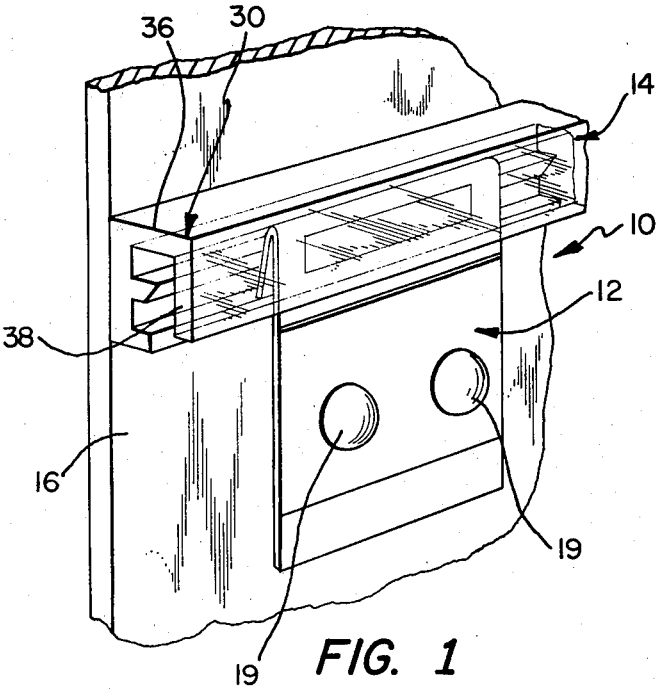
FIG. 1 is a fragmentary perspective view of the display device of the instant invention mounted on a supporting surface.
Figure 2:
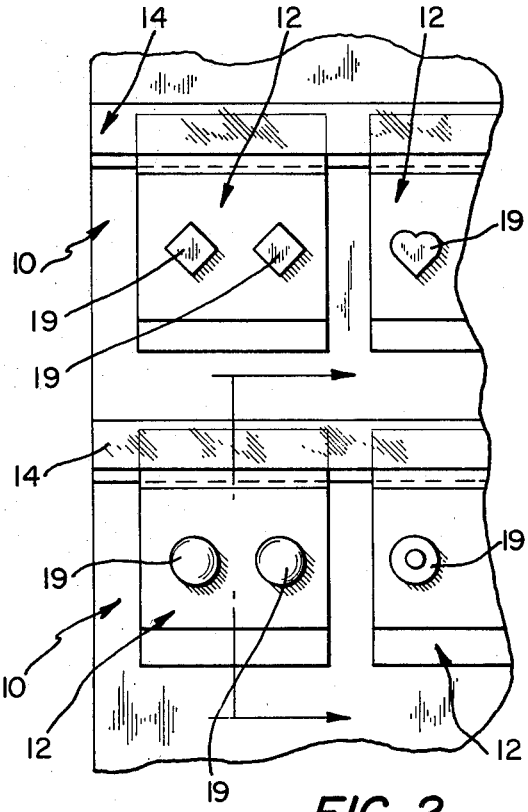
FIG. 2 is a fragmentary front elevational view of a supporting surface with a plurality of the display devices of the instant invention mounted thereon.

Referring now to the drawing, the jewelry display device of the instant invention is shown generally at 10 in FIGS. 1 through 5. As will be noted, the display device 10 comprises a display card generally indicated at 12 and a hanger generally indicated at 14 which is mounted on a supporting surface 16. Preferably the surface 16 comprises a plastic plate to which the hanger 14 is cemented or otherwise secured. The hanger 14 is preferably constructed of extruded plastic. The card 12 is preferably made of cardboard or other similar lightweight, inexpensive, structurally weak material.

The configuration of the card 12 is shown most clearly in FIGS. 3 through 6. As will be noted, the card 12 has a main portion 18 adapted to recieve articles of jewelry 19 thereon and a flap portion 20, with a score line 22 defining the intersection of portions 18 and 20. As will be further noted, the card 12 is foled along the score line 22 thereby providing a hinged attachment for the flap portion 20 to the main portion 18, with the flap portion 20 extending rearwardly and downwardly from the score line 22 in outwardly biased relation to main portion 18.

As will be noted, most clearly in FIG. 1, the hanger 14 extends substantially horizontally across the supporting surface 16 having a support member or rear wall 24 which is attached to the surface 16, and a lower rib 26, a fulcrum rib 28, and an L-shaped member generally indicated at 30 which extend outwardly from the support member 24. As will be noted, the lower rib 26 is disposed at the bottom of the support member 24 and has a substantially horizontal flat upper surface 32. The fulcrum rib 28 is spaced above the bottom rib 26 a distance less than the length of the flap 20, extending outwardly from the support member 24 and terminating in a bevelled outer end 34. The L-shaped member 30 has a substantially horizontal portion 36 which extends outwardly from the support member 24 and is spaced above the fulcrum rib 28 a distance less than the length of the flap 20, and a vertical portion 38 which extends downwardly in front of the fulcrum rib 28 in spaced relation thereto. As will be further noted, the vertical portion 38 terminates substantially at the horizontal plane of the upper surface 32 of the lower rib 26 and has a substantially flat vertical inner surface 40 which is spaced slightly outwardly from the end 34. It will also be noted that the end of rib 26 is in substantially the same plane as the rearward most portion of bevel 34.

Figure 3:
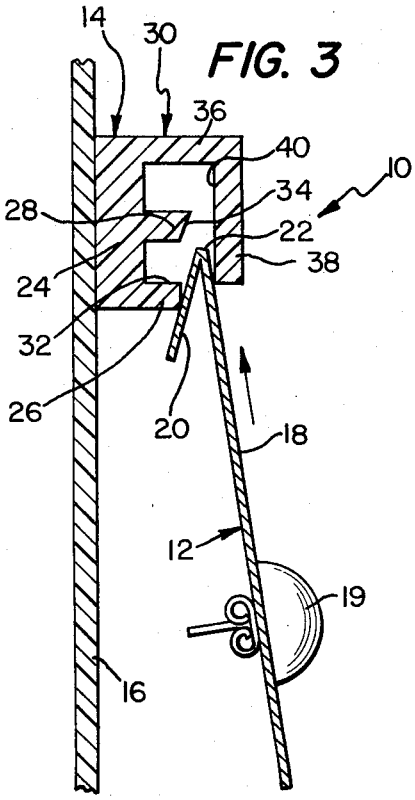
FIG. 3 is an enlarged side sectional view of the display device of the instant invention illustrating the insertion of a display card in the hanger.
Figure 4:
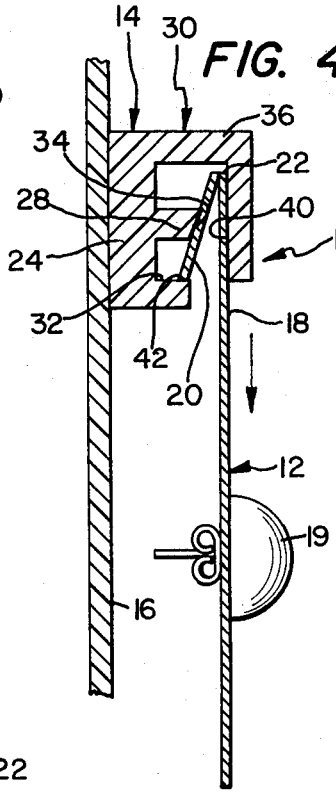
FIG. 4 is an enlarged side sectional view of the display device taken along line 4—4 in FIG. 2 with a display card fully engaged in the hanger.
Figure 5:
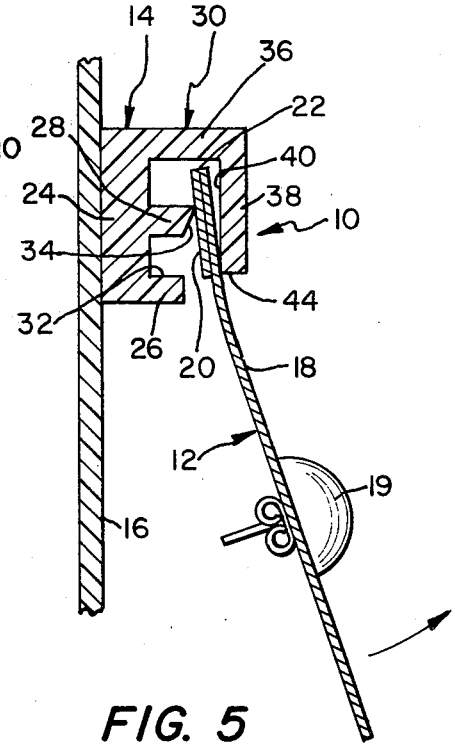
FIG. 5 is an enlarged side sectional view thereof, illustrating the disengagement of the card from the hanger.
Figure 6:
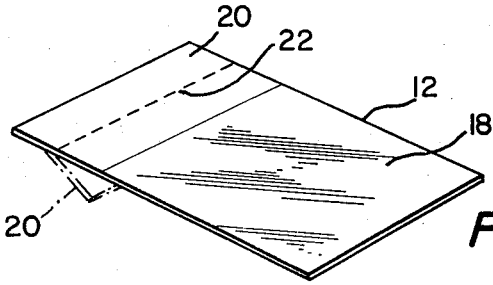
FIG. 6 is a perspective view of the display card per se, with the folded flap shown in broken lines.

In use the card 21 is secured to the hanger 14 as illustraded in FIG. 3 by inserting the upper ends of the folded card 12 into the opening on the bottom end of the hanger 14 between the end of the lower rib 26 and the vertical leg 38. As the card 12 is moved upwardly, the flap 20 is depressed inwardly toward the main portion 18 until the bottom end of the flap 20 reaches the horizontal plane of the surface 32 whereupon the outward biasing of the flap 20 causes it to be hinged outwardly snapping into place. The position of the card 12 when it is in place and attached to the hanger 14 is illustrated in FIG. 4. As will be noted, in this position the upper portion of the front surface of the main portion 18 abuts the surface 40 and the flap 20 extends downwardly and inwardly with the end 34 engaging the flap 20 at an intermediate point in its extension and with the bottom end of the flap 20 resting on the surface 32 as at 42 to provide vertical support for the card 12 in the hanger 14. In this position the card is securely held against removal by a downward thrust, notwithstanding the inherent structural weakness of the card. The card 12 may, however, be easily disengaged from the hanger 14 simply by applying a slight outward force to the bottom end of the main portion 18. As will be noted, particularly from FIG. 5, when the bottom of the main portion 18 is moved slightly outwardly, the main portion 18 pivots on the bottom end of the vertical portion 38 as at 44 causing the flap 20 to be pressed against the end 34 thereby depressing the flap 20 against the main portion 18. As will be noted, the card 12 may thereafter be removed from the hanger 14 simply by sliding it downwardly.

It is seen therefore that the display device of the instant invention provides a neat and simple means of suspending a card from a supporting surface. Further, while the device is particularly suited for the display of jewelry, it is obvious that it is well suited for other types of displays wherein an article is mounted on a card which is suspended from a supporting surface. Although the card may be constructed of a lightweight, inexpensive material, such as cardboard, it is still securely held when engaged with the hanger, and since removal of the card requires a specific sequence of operation, which would not normally be evident to one looking at the display, the incidence of pilferage is substantially reduced.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A display assembly for jewelry and the like comprising:

a. a substantially vertically disposed card having a main portion and an outwardly biased flap hingedly attached to the top edge thereof extending downwardly and outwardly therefrom; and b. a hanger for suspending said card comprising;

i. support means engageable with the bottom edge of said flap to support said card;

ii retaining means engageable with the side of said card opposite from said flap to retain the bottom edge of said flap in engagement with said support means; and iii fulcrum means engageable with said flap at an intermediate point in its extension causing said flap to be hinged inwardly toward said card when said flap is pressed against said fulcrum means.

2. In the assembly of claim 1, said card being defined by a single sheet of cardboard which is folded along a substantially horizontal score line providing the hinged attachment of said flap, said biasing resulting from the natural resiliency of said cardboard at said score line.

3. In the assembly of claim 1, said hanger further comprising a support member attached to a substantially vertical supporting surface and extending substantially horizontally a distance thereacross, said support means comprising a supporting rib projecting outwardly from said support member and extending a distance substantially horizontally therealong, the bottom edge of said flap engaging the upper surface of said rib to thereby provide vertical support for said card.

4. In the assembly of claim 3, said fulcrum means comprising a fulcrum rib projecting outwardly from said support member and extending a distance substantially horizontally therealong, said fulcrum rib being spaced above said supporting rib a distance less than the height of said flap, said fulcrum rib engaging said flap at an intermediate point with said flap extending upwardly and outwardly from said supporting rib.

5. In the assembly of claim 4, said fulcrum rib projecting outwardly from said support member slightly further than said supporting rib, the outer end of said fulcrum rib being inclined slightly upwardly and outwardly and abutting said flap.

6. In the assembly of claim 5, said retaining means comprising an L-shaped member which extends outwardly from said support member and is spaced above said supporting rib a distance greater than the height of said flap and substantially vertically downwardly in front of said fulcrum rib spaced outwardly from the outer end thereof, said L-shaped member extending for substantially the horizontal extent of said support member, the upper portion of the outer surface of said card abutting the inner surface of the vertical portion of said L-shaped member.

7. In the assembly of claim 6, the vertical portion of said L-shaped member extending downwardly substantially to the horizontal plane of the upper surface of said supporting rib.

8. In the assembly of claim 6, said support member, said supporting rib, said fulcrum rib, and said L-shaped member being of unitary plastic construction.

9. In the assembly of claim 5, the end of said supporting rib being in substantially the same vertical plane as the bottom edge of said fulcrum rib outer end.

* * * * *